United States Patent [19]

Rehkemper et al.

[11] Patent Number: 4,552,363

[45] Date of Patent: Nov. 12, 1985

[54] BOARD GAME HAVING STACKABLE TILES AND MOVEABLE PLAYING PIECES

[75] Inventors: Steven F. Rehkemper, Chicago; Donald A. Rosenwinkel, Oak Park; John V. Zaruba, Chicago; Jeffrey D. Breslow, Highland Park, all of Ill.

[73] Assignee: Marvin Glass & Associates, Chicago, Ill.

[21] Appl. No.: 550,967

[22] Filed: Nov. 14, 1983

[51] Int. Cl.[4] ..... A63F 3/00

[52] U.S. Cl. ..... 273/241; 273/284; 273/290; 273/291

[58] Field of Search ..... 273/236, 241, 242, 276, 273/243, 290, 260, 283, 291, 264, 262, 287, 261, 282, 288, 289; 434/195; 446/85, 117, 125, 128

[56] References Cited

U.S. PATENT DOCUMENTS

| | | | |
|---|---|---|---|
| 2,055,159 | 9/1936 | Scofield | 273/291 X |
| 3,414,986 | 12/1968 | Stassen | 434/195 |
| 3,603,591 | 9/1971 | Shoptaugh | 273/282 X |
| 3,608,902 | 9/1971 | Weisbecker | 273/283 X |
| 3,608,904 | 9/1971 | Margetson | 273/260 X |
| 3,993,313 | 11/1976 | Tillotson | 273/290 X |

FOREIGN PATENT DOCUMENTS

| | | | |
|---|---|---|---|
| 2260365 | 9/1975 | France | 273/264 |

*Primary Examiner*—Richard C. Pinkham
*Assistant Examiner*—Matthew L. Schneider
*Attorney, Agent, or Firm*—John S. Pacocha

[57] ABSTRACT

A game in which the players construct a three dimensional playing field during the course of play using pieces that include assigned tokens and common tiles. Each of the tiles is divided into a number of spaces such that each space is adapted to support either an assigned token or a portion of another tile with latter establishing a new level. A board provides a base surface with markings for the placement of the first level of tiles. Each of the tiles is constructed such that its upper surface can support other tiles or tokens. The tokens are supported by recesses located on the upper surface of the tiles. Other tiles are supported by intersecting slots located on the upper surface of the tiles. The game is won by the first player to place an assigned token atop a preselected level.

16 Claims, 12 Drawing Figures

BOARD GAME HAVING STACKABLE TILES AND MOVEABLE PLAYING PIECES

BACKGROUND OF THE INVENTION

1. Field of the Invention

This invention relates generally to games and more particularly to a three dimensional strategy game.

2. Background Art

Strategy games which do not rely on chance have long been popular pastimes. Variations of classic strategy games, including checkers and chess, have involved multi-level, or three dimensional, game play. For example, U. S. Pat. No. 2,313,473 is directed to a three dimensional variation of "Tic-Tac-Toe". A later U. S. Pat. No. 3,791,649 is also directed to a three dimensional board game. There remains, however, a need for new, portable, compactly storable, three dimensional strategy games providing challenging competitive play, particularly with variation from game to game in the three dimensional aspect.

SUMMARY OF THE INVENTION

The present invention is concerned with providing a three dimensional strategy game for at least two players that is readily storable and portable in its disassembled state and, in which, the players themselves establish the multi-level playing surface during the course of play. These and other objects and advantages of the invention are achieved by a game that supplies playing pieces including a common set of tiles which each player may use, plus assigned sets of tokens. A board is provided that has a surface divided into a plurality of spaces marked for placement of a first level of pieces. Each of the tiles is divided into a number of playing spaces with each space adapted to support a token or a portion of another tile. The board is marked for the initial placement of first level tiles at the start of the game. Succeeding levels may be built by three space support of tiles on top of tokens and/or portions of underlying tiles. The first player to place an assigned token atop a preselected level, such as the fifth level, is the winner of the game.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
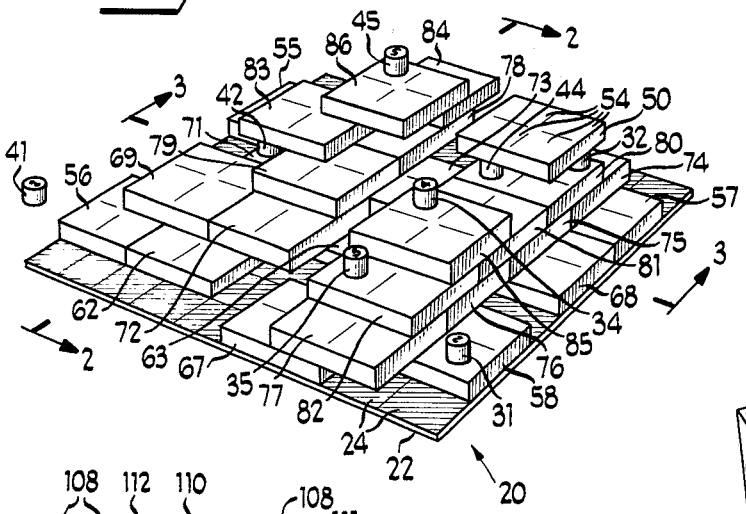
FIG. 1 is a perspective view of an embodiment of the present invention showing a game that has been played to a conclusion.

Referring now to the drawings in which like parts are designated by like reference numerals throughout the several views, there is shown in FIG. 1 a game 20 embodying the present invention which has been played to a successful conclusion. The particular game shown in the drawings is conveniently played to the fifth level although a lesser or greater number of levels may be used. An underlying base or board 22 of the type of construction often used in board games wherein the board is foldable down a center line for more compact storage is provided. Alternatively, a flexible sheet could be employed for marking a starting pattern for the first level of play. The board 22 is divided into a number of congruent square spaces 24 each having at least one corner forming part of a center 25 of a larger square or tile block. As is best shown in the top plan view of the board in FIG. 4, four starting blocks 26 indicated by color or some other suitable marking are provided on the board.

A set of movable tokens 31 through 35 and 41 through 45, respectively, is assigned to each player. Each of the assigned tokens are conveniently made in a cylindrical form. While the tokens could be of a shape other than cylindrical, it is required that all of the tokens be of a uniform height and have a width that conveniently fits within a space equivalent to space 24 on the board while being broad enough to support a portion of a larger piece on top of the tokens. The tokens may either be cut to a uniform length from a rod or molded. If molded, it may be advantageous to make the pieces with a hollow interior in order to save material.

Each cylindrical token is provided with a number "2", "3", "4", or "5", on both ends to designate the number of moves to be made with the token. The number is the same on each end of a particular token. By color or some other distinguishing means, each of the opposed ends is associated with one of the players. Thus, for example, tokens 31 and 41 are identical, each having one end with a red "2" and the other end with a blue "2". However, in play, as shown in FIG. 1, token 31 is rotated to have the red "2" showing while token 41 has the blue "2" on top to distinguish to which player the particular token is assigned.

In this embodiment, which is to be played to the fifth level, each player is assigned five tokens bearing numbers as follows: two "2"s, namely 31 and 32 or 41 and 42; one "3", namely 33 or 43; one "4", namely 34 or 44; and one "5", namely 35 or 45. If the game is to be played to a lesser number of levels, such as for example four levels, tokens 35 and 45 may be removed from play. On the other hand, if the game is to be played to the sixth level, an additional token (not shown) bearing the number "6" would be provided for each player.

In addition to the assigned tokens the playing pieces include about forty square tiles such as 50 (not all of which are shown). As with the cylindrical tokens, the tiles may be cut to an equal height from solid square stock or made with a hollow interior to save material. The top surface of tile 50 and the other similar tiles are divided into a series of four spaces 54 which are congruent with the spaces 24 on the board 22. Accordingly, the overall lateral size of the tiles 50 conforms to the large square tile blocks defined about the centers 25 on the board as well as the starting blocks 26.

The sides of each of the spaces 54 are each greater, preferably about twice greater, than the diameter of a token. Accordingly, a token may easily be positioned within the selected allowed space 54 on a tile. Even though a side length of much more than twice the diameter of the cylindrical tokens would still facilitate positioning of a token within a space, the much greater size would not provide ample and facile enough support for a portion of another tile atop the token.

Figure 4:
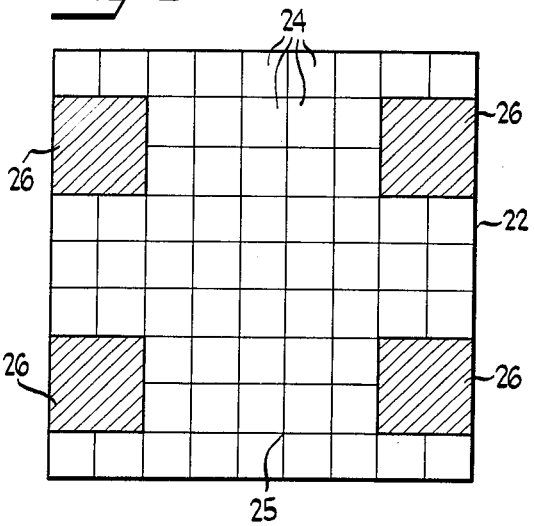
FIG. 4 is a top plan view of the board in isolation.
Figure 7:
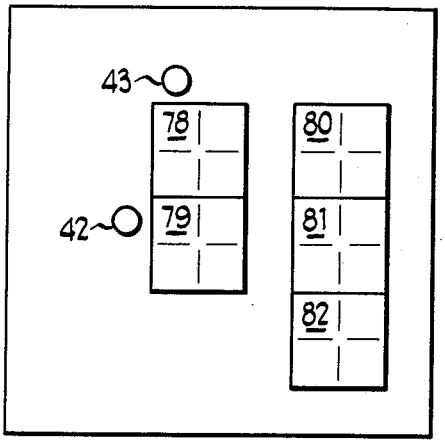
FIG. 7 is a reduced scale top plan view of the third level of the game in isolation.
Figure 5:
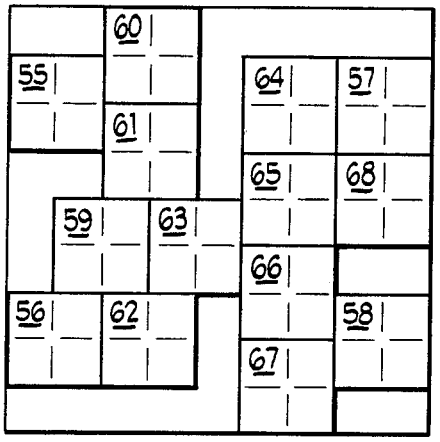
FIG. 5 is a reduced scale top plan view of the first level of the game in isolation.
Figure 8:
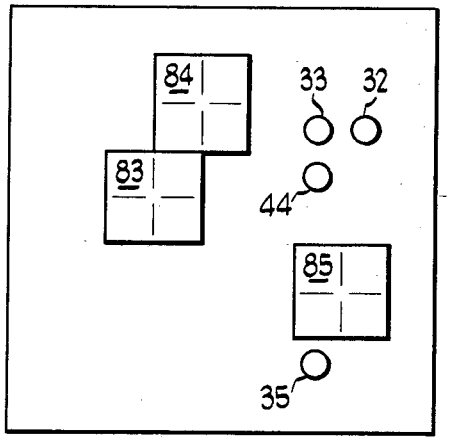
FIG. 8 is a reduced scale top plan view of the fourth level of the game in isolation.
Figure 6:
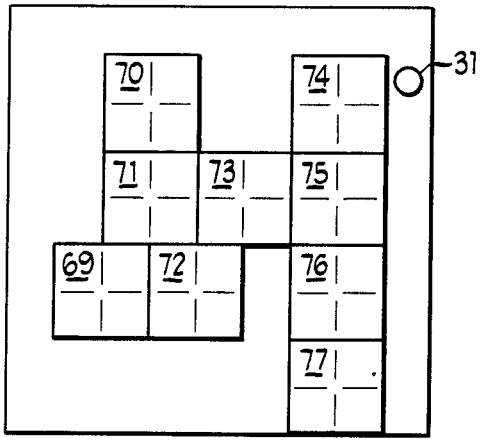
FIG. 6 is a reduced scale top plan view of the second level of the game in isolation.
Figure 9:
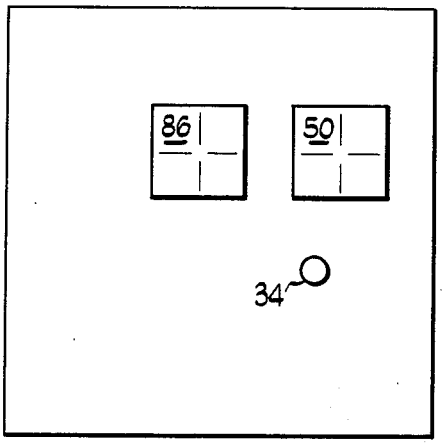
FIG. 9 is a reduced scale top plan view showing the fifth level of the game.

The embodiment shown, as is best indicated in the top plan view of the board in FIG. 4, has a board that is nine spaces by nine spaces. This layout of the board could be increased or decreased by a number of spaces to provide for a more complicated and lengthy game or a simpler quicker game, respectively. Particularly if the number of spaces is increased, or if the game is to be played to a higher level, more than forty tiles should be supplied to allow for the increased variations of construction that will result. It may also be desireable to supply less than forty tiles if, as another alternative embodiment, the game is simplified in order to reduce cost.

The board may be provided with either an odd or even number of spaces. However, an odd number of spaces per side tends to force early expansive play both upon the first level and with respect to constructing additional levels. With an odd number of spaces, single space gaps necessarily occur between placed tiles requiring the placement of either connecting tiles on the same level or an additional level of bridging tiles.

To start play, each player places two tiles on the starting squares 26 on the edge of the board 22 adjacent the player. The players' tokens must be brought into play through the tiles 55–58 placed on the starting blocks. To facilitate recognition of the starting tiles throughout the play of the game the starting tiles themselves may be colored coded to conform with the starting blocks 26 or otherwise identified. Alternatively, a border may be placed around the outside of each of the starting blocks on the board so that they remain discernible even after the tiles are placed on top of the blocks 26. The players may determine which is to start by blindly picking tokens with the player receiving the higher number being the one to start.

In placing the first level tiles 59–68, each tile must be placed adjacent to one already on the board so that at least one-half of one side of the newly placed tile is abutting a tile already on the board. Players may start placing tiles on a new level at any time that the underlying level provides support under at least three of the four spaces 54. However, a tile being placed on an upper level may not rest on more than one-half of any single tile beneath it. Once a level is started, additional tiles placed on that level need not have at least one-half of the one side abutting an already placed tile as on the first level.

The required three space support for the upper level tiles 68–86 and 50 results from various combinations of underlying tokens and/or portions of already placed tiles. Thus, a tile such as 50 may be supported atop the three tokens 32, 33 and 44. The required three space support for tile 86 is provided by two spaces of tile 84 and one space of tile 83 and for tile 84 by the combination of two spaces of tile 78 and token 43 while tile 83 is supported upon one space of each of tiles 78 and 79 plus token 42. A tile may be placed on a lower level even after a higher level has been established but may not be placed under an overhanging or cantilevered portion of a tile such as 50 even if there was the requisite support. By placing a tile such as 50, a player may trap an opponent's token using the opponent's token as one of the three points of support. Thus trapped, the token is out of play for the remainder of the game. At times, a player may choose to sacrifice one or more of the player's own tokens in order to strategically place a tile.

Each player's move or turn consists of moving any two of the player's tokens and then placing a tile. The tokens move only on the tile spaces 54. Players may use tokens that are already on a tile and free to move or bring additional tokens on through the tiles 55–58 initially placed atop the starting blocks. Within a move, each token must be moved the number of spaces designated by the number of the end. Tokens are moved from space to space in a straight line or in right angle turns; no diagonal moves are allowed. A token may not be on the same space twice within a single turn or be moved under an overhanging or cantilevered tile such as 50, 83 or 86. In ascending levels, the tokens may only move one level at a time, thus token 35 may move up from tile 82 to tile 85 but token 31 may not jump up the two levels to tile 82. Tokens may be moved to a lower level as well as to a higher level during play. Once the player moves the required two tokens, the turn is completed by placing another tile on the board or on another level.

A token may not jump over another token. If the player's token ends a move on an opponent's token, the opponent's token is captured. As a result of capture the opponent's token is removed from the board and is turned over to the capturing player's color to be used by that player in later play. The number on the ends of the tokens have no bearing with respect to capture.

It is possible to surround a token with tiles so that the token can not move out of a restricted area and further tiles may not be placed to provide an escape for the token. If a token is so blockaded in an area of less spaces than the token is required to move, the token is "dead". However, when the token can move, such as a token with a numerical indicator of "three" being blockaded within a four space area, the token remains "live". Should a player only have a "live" blockaded token left, the player remains in the game despite being able to move only one token and may place tiles in an attempt to trap and/or blockade the opponent's token.

Play continues with the movements of tokens and the placing of the tiles until the fifth level of tiles is reached in the embodiment shown and described. Any number of tiles may be placed upon the fifth level but none may be placed any higher. Thus, a player may not trap a token that is located on the fourth level. The first player who is able to finish the move of a token on the surface of a fifth level tile wins the game. A player may also win the game by capturing, trapping and/or blockading all of the opponent's tokens so that none may be moved the required number of spaces. If a player has only one movable token, the player remains in the game and may move the single token and then place a tile. The game results in a draw if both players have at least one movable token but neither player may place a tile on the fifth level or any lower level.

Figure 10:
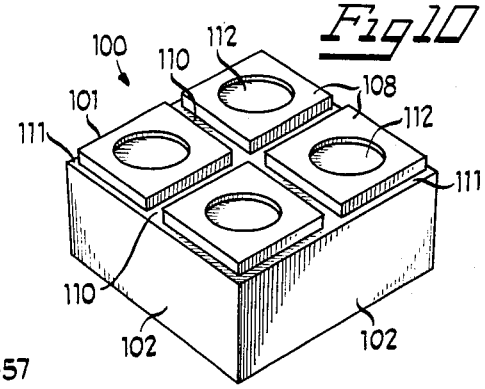
FIG. 10 is an enlarged scale perspective view from the top of a tile playing piece.
Figure 11:
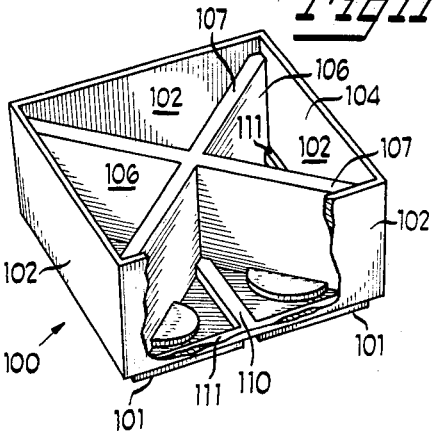
FIG. 11 is an enlarged scale perspective view from the bottom of the tile playing piece shown in FIG. 10.

It may be difficult to manufacture the tiles with a hollow interior and a solid bottom surface. Accordingly, the tiles may be injection molded of plastic in the form of tile 100 shown in FIGS. 10 and 11. Top surface 101 and peripheral walls 102 define a hollow, open bottom, interior 104. Internal support struts in the form of intersecting diagonal ribs 106 extend between the walls 102 within the hollow interior 104 to strengthen the tile. The ribs 106 depend from adjacent the underside of the top surface 101 to a plane above the bottom of the sides 102. Bottom edges 107 of the ribs 106 provide a surface for support of a portion of the tile atop a cylindrical token.

Four square spaces 108 are defined on top surface 101 by a pair of intersecting recessed slots 110 and a peripheral recess or ledge 111. The width of each slot is somewhat greater than twice the thickness of the peripheral walls 102, but preferably less than three times greater than the thickness of the walls 102. Ledge 111 is conveniently one-half the width of the slot 110. Each recessed slot 110 is parallel to, and substantially equally spaced from, a pair of peripheral walls 102. Thus, the side 102 of a tile being placed atop another tile, whether covering one or two of the spaces 108, will be received in a recessed slot to help align the tiles as well as to stabilize the multi-level structure should it be jarred during the course of play. Slot 110 will accommodate the sides 102 of two different tiles so that portions of more than one tile may be placed atop a single tile, such as 63.

Each of the square spaces 108 is provided with approximately centered circular recess 112 of a diameter slightly greater than the diameter of the token. The recesses key the tokens to properly position the tokens to provide adequate support for an upper level tile as to help stabilize the tokens to prevent inadvertent dislocation during the course of play. With a tile such as 100, the height of the cylindrical tokens should be greater than the height of a tile by the depth of the key recess 112 plus the length of the peripheral wall 102 protruding beyond the bottom edge 107 of the struts. Conveniently, the depth of the cross slots 110, the depth of the circular key recess, and the length of the side walls protruding beyond the struts may all be the same dimension.

Figure 12:
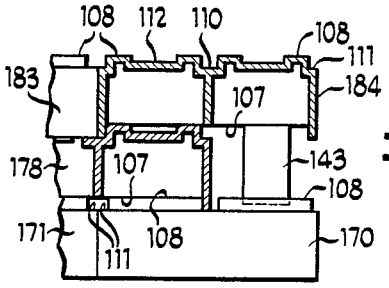
FIG. 12 is a fragmentary vertical sectional view through three levels of pieces.
Figure 2:
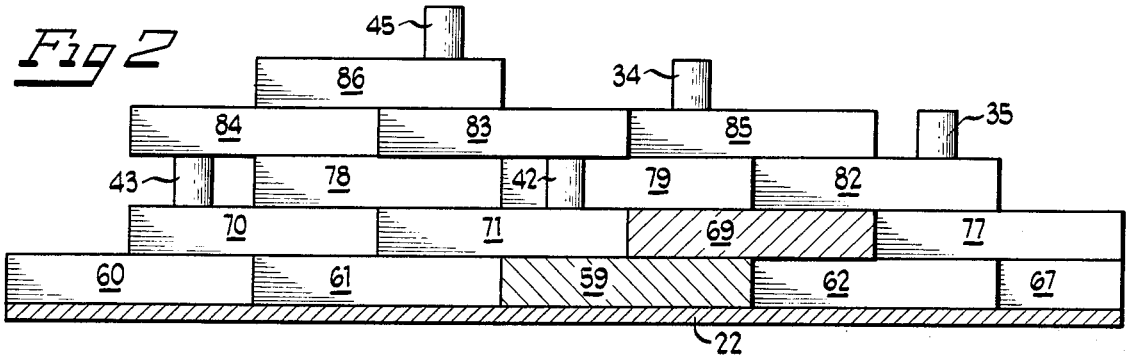
FIG. 2 is an enlarged scale sectional view taken generally along the line 2—2 of FIG. 1.
Figure 3:
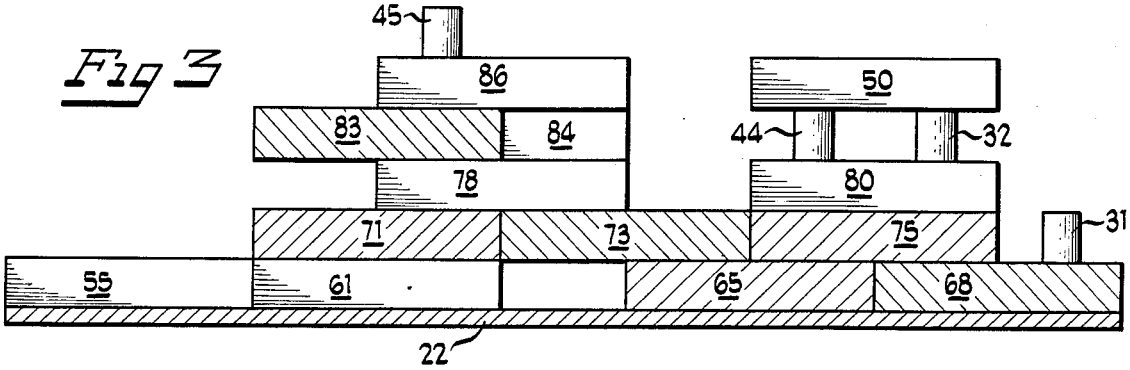
FIG. 3 is an enlarged scale sectional view taken generally along the line 3—3 of FIG. 1.

To illustrate how the pieces fit together using tiles 100, a fragment of the game shown in FIGS 1–9 is shown in section in FIG. 12 with the last two digits of the reference numerals for the pieces in FIG. 12 being the same as the reference numerals of the pieces in the game. Tile 184 is supported atop token 143 and one-half of tile 178. A fragment of the quarter portion of tile 183 that is supported by tile 178 is also shown. Token 143 is seated in the recess of tile 170 and tile 178 has one space supported on each of tiles 170 and 171 plus a third tile (not shown).

While a particular embodiment of the invention has been shown and described, it will be apparent to those skilled in the art that various changes and modifications may be made without departing from the present invention. It is intended in the appended claims to cover all such changes and modifications as fall within the true spirit and scope of the invention.

What is claimed as new and desired to be secured by Letters Patent is:

1. A game for two players comprising:
a plurality of pieces;
the pieces including a set of cylindrical tokens assigned to each player;
each token having opposed ends;
the opposed ends of each token having means designating the number of moves that may be made with the token and means associating each end with one of the players;
the pieces also including tiles useable by each player;
each of the tiles having a bottom and a top surface divided into four congruent spaces;
the top surface of each of the tiles further including:
first key means for positioning an end of a cylindrical token on each of the spaces;
second key means for the positioning of the bottom of another of the tiles on each of the spaces of the top surface; and
each of the tiles being adapted to be supported upon a combination of underlying pieces.

2. The game of claim 1 including a game board having a base surface defining placement positions for a first level of pieces.

3. The game of claim 2 in which the base surface has markings to indicate piece placement at the start of the game.

4. The game of claim 3 in which the markings include portions that extend beyond the periphery of the pieces and are thus discernible after the pieces have been placed at the start of the game.

5. The game of claim 1 including:
a game board having a base surface divided into a plurality of congruent spaces that are also congruent with the spaces on the top surface of the tiles.

6. The game of claim 1 in which the first key means is a recess for receiving a token.

7. The game of claim 1 in which:
each tile has peripheral walls of substantially equal height and thickness that depend from the top surface to a lower edge; and
the tile has a hollow interior with a substantially open bottom.

8. The game of claim 7 including support struts extending between peripheral walls within the hollow interior.

9. The game of claim 8 in which the support struts comprise intersecting diagonal ribs.

10. The game of claim 8 in which the struts depend from adjacent the underside of the top surface a distance less than the height of the peripheral walls.

11. The game of claim 7 in which:
the second key means includes a pair of intersecting recessed slots;
each slot is substantially parallel to, and substantially equally spaced from, a pair of opposed peripheral walls; and
each slot is of a width somewhat greater than twice but less than three times the thickness of the peripheral walls.

12. The game of claim 11 in which the tile has a support strut extending between peripheral walls and depending from adjacent the underside of the top surface a distance less than the height of the peripheral walls.

13. The game of claim 1 in which the first key means includes a recess.

14. The game of claim 1 in which the second key means includes intersecting slots on the top surface of the tiles.

15. The game of claim 14 in which:
each tile has peripheral walls of substantially equal height and thickness that depend from the top surface to a lower edge; and
the slots are of a width greater than the thickness of the struts.

16. The game of claim 1 in which the first key means includes recesses on the top surface of the tile and the second key means includes intersecting slots on the top surface of the tiles.

* * * * *